US005224247A

United States Patent [19]

Collier

[11] Patent Number: 5,224,247

[45] Date of Patent: Jul. 6, 1993

[54] STRAP FASTENER

[75] Inventor: Michael R. Collier, Denver, Colo.

[73] Assignee: Harmony Fastening Systems, Inc., Denver, Colo.

[21] Appl. No.: 732,454

[22] Filed: Jul. 18, 1991

Related U.S. Application Data

[63] Continuation-in-part of Ser. No. 257,728, Oct. 14, 1988, abandoned.

[51] Int. Cl.[5] ..... A44B 11/25

[52] U.S. Cl. ..... 24/579.1; 24/575

[58] Field of Search ..... 24/579.1, 163 R, 578, 24/577, 584, 585, 583, 653, 664, 662, 663

[56] References Cited

U.S. PATENT DOCUMENTS

| | | |
|---|---|---|
| D. 222,408 | 10/1971 | Watson . |
| D. 235,385 | 6/1975 | Smyth . |
| D. 285,864 | 9/1986 | Sakai . |
| D. 299,480 | 1/1989 | Harari . |
| D. 308,294 | 6/1990 | Krasner . |
| D. 308,295 | 6/1990 | Sherlin . |
| D. 310,136 | 8/1990 | MacDonald . |
| D. 310,447 | 9/1990 | MacDonald . |
| D. 310,753 | 9/1990 | Stillwagon et al. . |
| D. 317,080 | 5/1991 | Stillwagon et al. . |
| 174,740 | 3/1876 | Read . |
| 230,495 | 7/1880 | Rae et al. . |
| 279,910 | 6/1883 | Candish . |
| 293,831 | 2/1884 | Wickers . |
| 302,421 | 7/1884 | Mosier . |
| 375,205 | 12/1887 | Sheldon . |
| 378,874 | 3/1888 | Davis . |
| 391,726 | 10/1888 | Voorhis . |
| 477,154 | 6/1892 | Quein . |
| 479,492 | 7/1892 | Davis . |
| 569,767 | 10/1896 | Quereau . |
| 702,056 | 6/1902 | Hancock . |
| 749,321 | 1/1904 | Perkins . |
| 796,414 | 8/1905 | Chayes . |
| 807,150 | 12/1905 | Boice . |
| 870,617 | 11/1907 | Falter . |
| 879,282 | 2/1908 | Mandeville . |
| 932,806 | 8/1909 | Paulson . |
| 949,014 | 2/1910 | Aikins . |
| 983,093 | 1/1911 | Svenson et al. . |
| 1,009,533 | 11/1911 | Lacey . |
| 1,024,566 | 4/1912 | Gifford . |
| 1,061,805 | 5/1913 | Beach et al. . |
| 1,095,794 | 5/1914 | Braeklein . |
| 1,185,913 | 6/1916 | Kittredge . |
| 1,197,431 | 9/1916 | Barrett . |
| 1,225,216 | 5/1917 | Boyer . |
| 1,243,018 | 10/1917 | Wallace . |
| 1,249,959 | 12/1917 | Hodges . |

FOREIGN PATENT DOCUMENTS

| | | |
|---|---|---|
| 16433 | 2/1904 | Austria . |
| 48558 | 6/1911 | Austria . |
| 134081 | 7/1933 | Austria . |

(List continued on next page.)

*Primary Examiner*—James R. Brittain

*Attorney, Agent, or Firm*—Kenton L. Freudenberg; Maxwell C. Freudenberg

[57] ABSTRACT

A novel buckle for fastening together strap ends, comprising two identical or identically shaped mating members, each member comprising two hook portions in spaced parallel planes, such hook portions straddling a center web portion, and incorporating a latching structure independent of and of lesser strength than the hook portions to prevent inadvertent unfastening of the buckle. The center web portions and outside surfaces of the hook portions and the base portions of the hooks are shaped to provide surfaces to accurately guide the members together or apart to facilitate fastening and unfastening the buckle. The engaged hooks form large surface areas of the front and back outer surfaces of the buckle. The buckle members are fastened and unfastened by essentially relative translational movement. Fastening of the buckle members is by movement of one buckle member relative to the other in one direction and unfastening movement may be other than merely a reversal of fastening movement and may be in a direction distinct from the direction opposite from the fastening direction.

31 Claims, 12 Drawing Sheets

U.S. PATENT DOCUMENTS

| | | |
|---|---|---|
| 1,252,261 | 1/1918 | Goubert . |
| 1,266,365 | 5/1918 | Whittaker . |
| 1,368,316 | 2/1921 | Zobl . |
| 1,499,428 | 7/1924 | Wagner . |
| 1,612,935 | 1/1927 | Mills et al. . |
| 1,678,166 | 7/1928 | Repay . |
| 1,759,550 | 5/1930 | Friedlander . |
| 1,851,733 | 3/1932 | Shapiro . |
| 1,909,654 | 5/1933 | Brown et al. . |
| 2,114,429 | 4/1938 | Roseman . |
| 2,347,263 | 4/1944 | Higgins et al. . |
| 2,379,896 | 7/1945 | Fitzgerald . |
| 2,392,659 | 1/1946 | Gore . |
| 2,406,895 | 9/1946 | Olson . |
| 2,447,422 | 8/1948 | Nelson . |
| 2,478,433 | 8/1949 | Swanson . |
| 2,478,434 | 8/1949 | Swanson . |
| 2,523,465 | 9/1950 | Graham . |
| 2,615,736 | 10/1952 | Bergan et al. . |
| 2,775,288 | 12/1956 | Anastasia . |
| 2,840,878 | 7/1958 | Olsen . |
| 2,896,290 | 7/1959 | Salm et al. . |
| 2,900,696 | 8/1959 | Bacon . |
| 2,956,324 | 10/1960 | Klein . |
| 3,080,635 | 3/1963 | Gunther et al. . |
| 3,120,971 | 2/1964 | Bengtsson . |
| 3,167,835 | 2/1965 | Bengtsson . |
| 3,196,878 | 7/1965 | Hedu . |
| 3,200,464 | 8/1965 | Cousins . |
| 3,251,110 | 5/1966 | Hedu . |
| 3,430,306 | 3/1969 | Tareau . |
| 3,583,317 | 6/1971 | Gibson . |
| 3,600,917 | 8/1971 | Krock . |
| 3,695,074 | 10/1972 | Smyth et al. . |
| 3,837,049 | 9/1974 | Corrado . |
| 3,979,934 | 9/1976 | Isenmann . |
| 4,150,464 | 4/1979 | Tracy . |
| 4,161,806 | 7/1979 | Hennisse . |
| 4,204,300 | 5/1980 | Fildan . |
| 4,363,159 | 12/1982 | Lischick . |
| 4,398,324 | 8/1983 | Bakker et al. . |
| 4,408,375 | 10/1983 | Skobel . |
| 4,413,383 | 11/1983 | Spalding . |
| 4,443,916 | 4/1984 | Tiemann . |
| 4,443,917 | 4/1984 | Oddenino . |
| 4,464,813 | 8/1984 | Bakker et al. . |
| 4,474,043 | 10/1984 | Morrone . |
| 4,489,466 | 12/1984 | Bakker . |
| 4,541,151 | 9/1985 | Herchenbach et al. . |
| 4,559,679 | 12/1985 | Downey . |
| 4,581,910 | 4/1986 | Brooks . |
| 4,616,953 | 10/1986 | Gomes . |
| 4,633,549 | 1/1987 | Lovato . |
| 4,662,040 | 5/1987 | Terrell et al. . |
| 4,672,725 | 6/1987 | Kasai . |
| 4,712,280 | 12/1987 | Fildan . |
| 4,726,705 | 2/1988 | Gomes . |
| 4,774,744 | 10/1988 | Kasai . |
| 4,776,191 | 10/1988 | MacDonald . |
| 4,779,315 | 10/1988 | Kohus . |
| 4,793,032 | 12/1988 | Crowle . |
| 4,928,364 | 5/1990 | Ikeda . |
| 4,982,480 | 1/1991 | Kasai . |
| 4,999,885 | 3/1991 | Lee . |

FOREIGN PATENT DOCUMENTS

| | | |
|---|---|---|
| 29431 | 2/1922 | Denmark . |
| 5855 | 12/1979 | European Pat. Off. . |
| 149102 | 7/1985 | European Pat. Off. . |
| 0228656 | 7/1987 | European Pat. Off. . |
| 222836 | 6/1910 | Fed. Rep. of Germany . |
| 1435829 | 1/1969 | Fed. Rep. of Germany . |
| 2062852 | 7/1972 | Fed. Rep. of Germany . |
| 466126 | 5/1914 | France . |
| 732885 | 9/1932 | France . |
| 759167 | 1/1934 | France . |
| 866047 | 6/1941 | France . |
| 896043 | 2/1945 | France . |
| 901042 | 7/1945 | France . |
| 943056 | 2/1949 | France . |
| 1026120 | 4/1953 | France . |
| 1047398 | 12/1953 | France . |
| 1067224 | 6/1954 | France . |
| 1297872 | 5/1962 | France . |
| 2135264 | 12/1972 | France . |
| 56748 | 7/1967 | German Democratic Rep. . |
| 411647 | 4/1945 | Italy . |
| 460433 | 6/1951 | Italy . |
| 39-11309 | 4/1961 | Japan . |
| 43-4035 | 2/1968 | Japan . |
| 55-3951 | 1/1980 | Japan . |
| 56794 | 8/1944 | Netherlands . |
| 18812 | 12/1907 | Norway . |
| 112813 | 12/1944 | Sweden . |
| 380423 | 9/1964 | Switzerland . |
| 1644 | of 1891 | United Kingdom . |
| 14765 | of 1892 | United Kingdom . |
| 8157 | of 1896 | United Kingdom . |
| 26631 | of 1898 | United Kingdom . |
| 20007 | of 1899 | United Kingdom . |
| 168861 | of 1922 | United Kingdom . |
| 779659 | 7/1957 | United Kingdom . |
| 1138122 | 12/1968 | United Kingdom . |
| 1332853 | 10/1973 | United Kingdom . |
| 2035440 | 6/1980 | United Kingdom . |

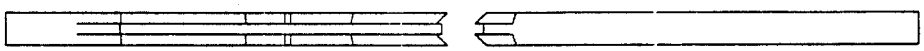
Fig. 28
Fig. 29
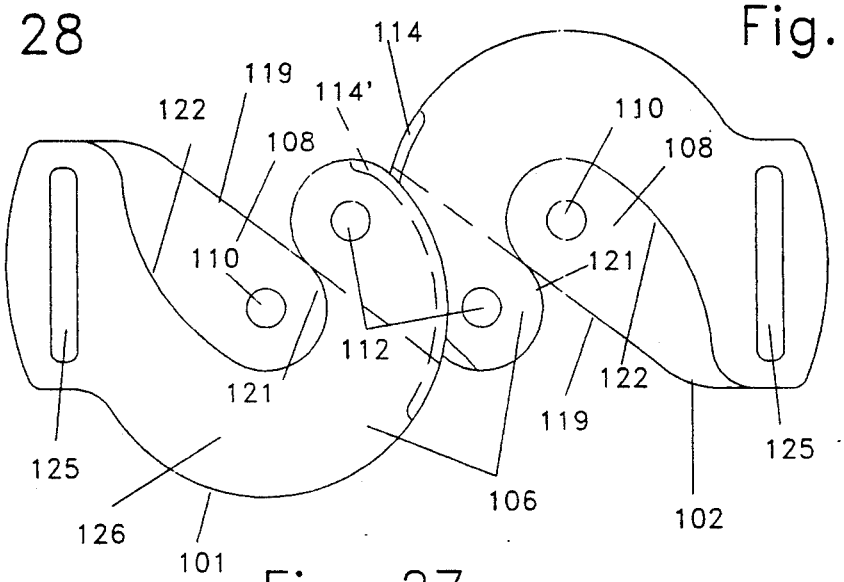
Fig. 27
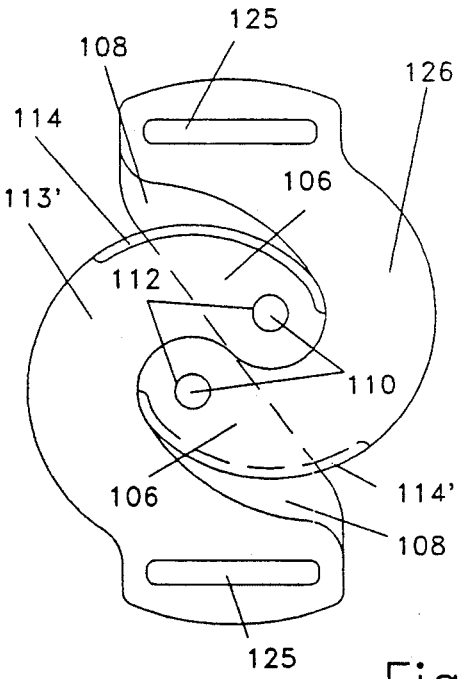
Fig. 33
Fig. 32
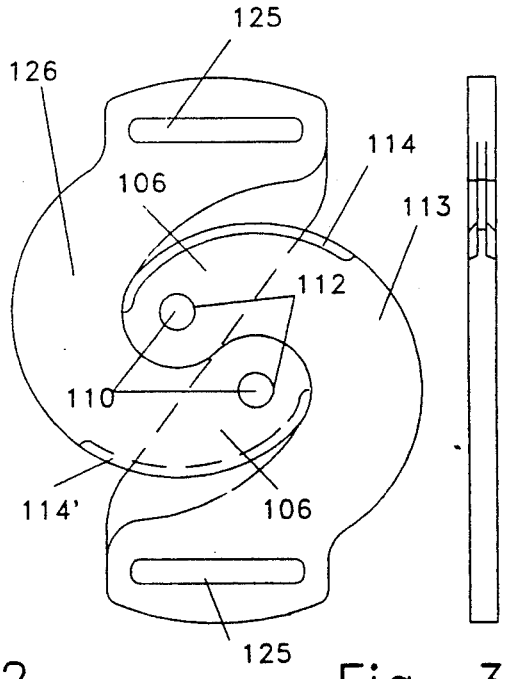
Fig. 30
Fig. 31

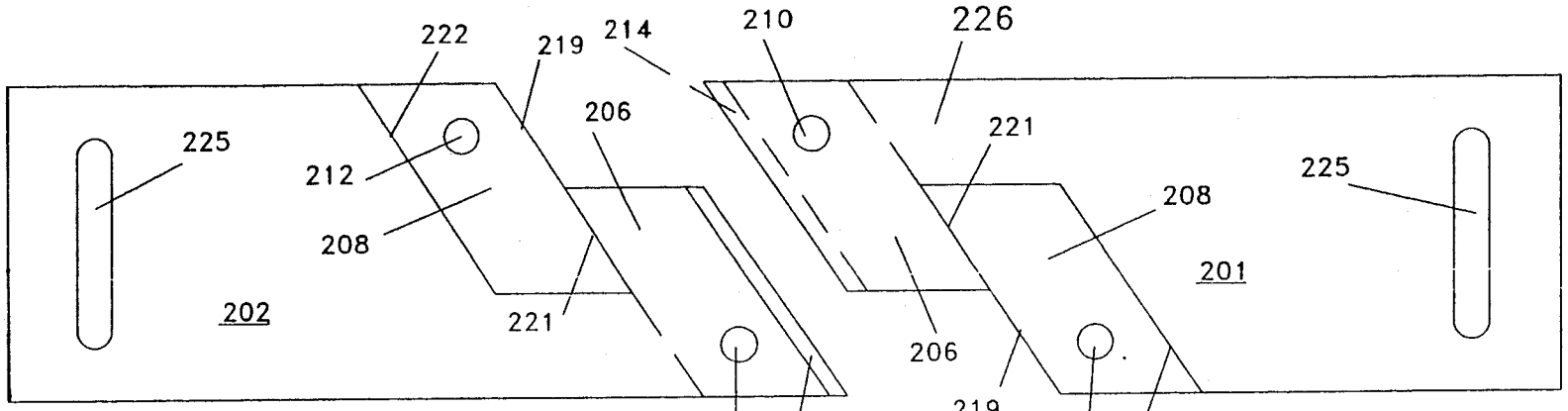
Fig. 34b
Fig. 34a
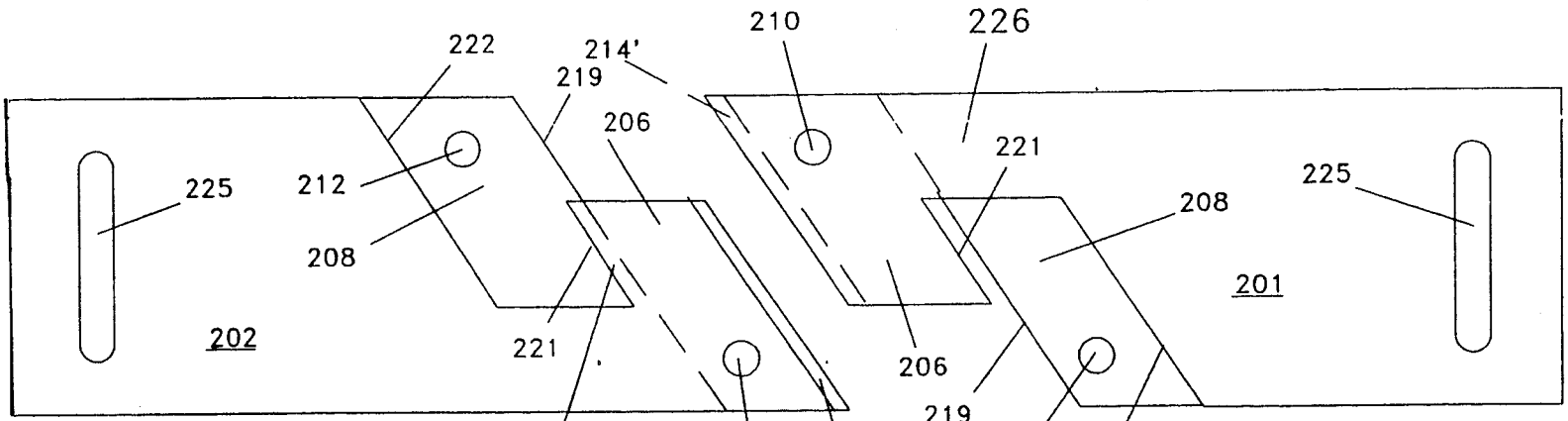
Fig. 35b
Fig. 35a

STRAP FASTENER

This application is a continuation-in-part of previous application, Ser. No. 07/257,728, filed Oct. 14, 1988, abandoned.

BACKGROUND OF THE INVENTION

The present invention relates to fasteners for connecting belt or strap ends and particularly to an improved two-member releasable buckle comprised of two identical components, or members having parts which are identically shaped, which are engaged with one another to securely fasten strap or belt ends together under heavy loads.

There are numerous types of buckles and fasteners commonly available for securing the ends of two straps together. Such buckles are commonly made out of molded plastic and comprise a male and a female member, each attached to a length of strap, and engaged with one another to fasten the ends of the straps to one another. One of the most common types of these buckles is made by the Fastex Company of Des Plaines, Ill. The fastening and release mechanism of this type of buckle comprises at least one relatively resilient male portion biased outwardly transversely toward a side edge so as to enable it to snap into place with a hooking action in a female buckle portion. The resilience of the male portion allows it to remain engaged with the female portion even in the absence of any tension on the buckle. Release is generally accomplished by squeezing the sides of the buckle at apertured points along the edges of the buckle assembly where each male portion is exposed. This action forces the male portion inwardly against its bias to disengage its hook from the receiving portion of the female portion and allows the male portion to be withdrawn. A version of a similar buckle using such a resilient hook means is shown in Lovato, U.S. Pat. No. 4,569,106. Lovato shows a buckle assembly in which each buckle-half member is identical and comprises one male and one female portion of the fastening mechanism.

In buckles using the action of a resilient hook such as described above, the security of the fastening is dependent entirely on the ability of the male portion to withstand tension as well as the certainty of the hooking action of the male portion(s) into the female portion(s). Because of the need for flexibility of the male portion in such a buckle and the resultant limited thickness of that portion in order to provide such flexibility, the ability of the buckle to resist tensile forces applied to the fastened buckle is compromised in order to provide a more readily operable release mechanism. Similarly, since such buckles are intended to be releasable with a minimum amount of relative movement of the engaging portions both the male and female portions have small engaging surfaces and corresponding support structures, each of which comprises only a relatively small portion of the transverse cross sectional area of the buckle. Such buckles are designed more toward their ease of release than toward their security in fastening. In use, buckles of this resilient hook type are also subject to wear of the hooking portions of the male and female portions since such hooking portions tend to have a small contact area. This wear is amplified by the increased abrasive action resulting from normal dust and dirt present in outdoor environments where such buckles are commonly used. Even a moderate degree of wear of the engaging portions of such buckles eventually results in a failure of the buckle's ability to withstand any significant tension applied to the straps or belts which the buckle is used to connect. By virtue of their ease of release, such buckles are also subject to inadvertent release when under tension. This makes them less desirable for use where a high degree of security is desired when the buckle is used to resist a significant load and where a releasable fastening means is desired. Such applications may include, for example, use of buckles in freight securing means, safety belts, harness assemblies for rock climbers and parachutists, or any application where straps are used for lifting.

SUMMARY OF THE INVENTION

The present invention, in contrast to the prior art, provides a buckle in which any load on the buckle is borne by a pair of cooperating and abutting large hooking portions and through a portion of the body of each member having a relatively large cross section rather than by only the narrow resilient male portion of small cross section of the fastening mechanism as in Lovato. The security of the fastening is virtually unaffected by normal wear of the hooking portions of each member. The majority of the cross sectional area of the body of a buckle member comprises a center web portion generally located in a plane parallel to and between the planes or strata of the hook portions. However, as seen in alternative embodiments, the transverse sectional dimensions of the hooks themselves may form a large strengthened portion of the cross sectional area. The web portion is straddled and sandwiched by the two hooking portions of the mating member when the buckle assembly is fastened. The hook fastening is further secured against unwanted release by the incorporation of a releasable latch means having relatively resiliently biased interengageable cooperating interfering surface portions, comprising, for example, a peg or protuberance on one member and structure defining a corresponding hole or recess on the mating member. The body is further shaped so edges of the hooks or of the web portions straddled by the hooks serve as guide surfaces so that unfastening and fastening the buckle can be accomplished with only simple manual relative translational movement, for example, by manually squeezing the aligned buckle members together transversely of the direction along which tension forces are to be applied to the buckle members to fasten, or squeezing the fastened buckle assembly from its strap ends to unfasten, without any need for specific manual guidance of the direction of movement of the two members. The fastening and unfastening movements of the coplanar pairs of hooks of the buckle members are essentially translational in their respective strata and include a principal movement which is oblique or transverse to the longitudinal or primary direction of the buckle members along which tension forces are to be applied to the opposite ends of the structures of the buckle members by the apparatus which they interconnect. In an alternative embodiment, the fastening movement may also be a translational direct end-to-end relative movement of the buckle members along their longitudinal or primary tension-resisting direction.

Usuda, U.S. Pat. No. 3,520,033, shows a buckle assembly utilizing a peg and hole latch means in which the engaging peg and hole portions are the load bearing structure of the buckle assembly. The buckle assembly disclosed by Usuda is such that any load in tension must be borne entirely by the components of the latching means and the latching function is dependent on frictional forces resulting from the load on the buckle assembly as described at line 1 column 3 of the Usuda patent. As will be more apparent from the detailed description hereinafter, the present invention recognizes the benefit achieved by making the structure for latching the buckle portions together essentially independent of the load bearing structure of the buckle. Also, unlike the illustrated embodiments of the present invention, Usuda requires a relative twisting of the buckle parts for both fastening and unfastening. Only by reconstructing the device of Usuda in light of the present invention can the Usuda buckle be made to achieve the goals of the present invention. The present invention suggests that the buckle of Usuda could be greatly enhanced by modifying each member half by repositioning the inner flange 1*b* and strap slot 7 of the drawings of the Usuda patent to the edge nearest the latch member 6 and opposite the engagement hole 5 so that the meeting inner edges of tabs 3 which abut each other as shown in FIG. 4 would allow tabs 3 to share the load of the buckle along with the latching means. Using FIG. 4 of Usada, the right member would have its strap attached at the bottom instead of the right as shown. Such a modification would also tend to increase the security under load of the latching means of Usuda by changing the axis about which the members must be twisted to unfasten them from parallel to the strap orientation to perpendicular to the strap orientation. This might limit the likelihood of the members twisting in a manner so as to tend to inadvertently disengage from one another. However in the absence of a load neither the buckle described in the Usuda patent nor the modification thereto described above would provide the fastening security of the interengaged hooks and latching means of the present invention where the latch means which prevents inadvertent separation is mechanically independent of both the load bearing means and any load on the buckle assembly. Release of the buckle of the present invention in its preferred embodiment is accomplished by exerting sufficient compressive force against the fastened buckle assembly to disengage the latching means and sliding the buckle members obliquely relative to one another in a translational movement so as to disengage the hooks.

The present invention lends itself well to a construction in which both mating members are identical. The benefit in manufacturing a buckle with such a construction is that a single mold shape can be used to form each of the two mating members. A related benefit in use is that a manufacturer of products incorporating such buckles need not take into account varying quantities of each of the buckle members which would be necessary in applications where buckle members of each of the two strap assemblies would be utilized in unequal proportions if such members were of different genders. This would occur, for example, where several male buckle members on one strap assembly could each be selectively engaged with one female buckle member on a cooperating strap assembly.

It is therefore an object of the present invention to provide a buckle assembly capable of handling a high load in tension with a high degree of security.

It is a further object of the present invention to provide a buckle in which any loading in tension is borne by body portions with relatively large cross sections, and correspondingly high strength resisting the tension load.

It is also an object of the present invention to provide a buckle with a means to guide the relative movement of the two mating members in fastening so that fastening and latching of the interengaging hooks may be accomplished with only a relatively simple initial alignment and the application of a force to bring the buckle members together, without any need for specific manual guidance of the relative movement of the buckle members.

It is another object of the present invention to provide a two part buckle for which manufacture is simplified since each part can be molded in the same mold.

It is still another object of the invention to provide improved buckle members without specific gender which are capable of-being joined and latched to any other identical member.

Further objects of the present invention are to provide a buckle in which any loading in tension is borne by portions of relatively flat hooks with relatively large cross sections, and correspondingly high strength resisting the tension load, and wherein the hooks are moved translationally generally parallel to the planes of the hooks for both fastening and unfastening of the buckle.

Another object of the invention is to provide an improved buckle having flat interengaged hooks wherein the hooks are moved translationally in opposite directions for fastening and unfastening, respectively.

Still another object of the invention is to have more than one distinct mode of relative translational movement of flat buckle members for fastening the members together.

Further objects of the invention are to provide an improved buckle construction in the relatively movable members are not only translationally moved end-to-end for fastening in a latched position, but also wherein these members may be manually moved further in the same general direction for unlatching and separation.

A further object, of the invention is to achieve an improved buckle having only slight resilient separating relative movement of two strong flat hooks of one flat buckle member generally perpendicular to the plane of the hooks to facilitate fastening these hooks to another flat buckle member by essentially translational movement relative to the other member.

DESCRIPTION OF THE DRAWINGS

FIGS. 11 and 12 show the function of the outer edge of the hooking portions as guide surfaces.

FIG. 13 shows the function of the edge of the web portion as a guide surface.

FIG. 14 shows the two buckle members fully fastened.

FIG. 27 is a plan view of another embodiment of the invention showing two buckle members with curved flat hook portions partially overlapping in the course of their end-to-end movement toward a fastened position.

FIGS. 28 and 29 are side views of the two buckle members of FIG. 27 before their end-to-end engagement.

FIG. 30 is a plan view of the buckle members of FIG. 27 after completion of their movement to a latched fastening position.

FIGS. 31–33 are the side and reverse views of FIG. 30.

FIGS. 34*a*–34*b* are plan views of another buckle embodiment showing two flat relatively interengageable buckle members having angularly shaped hook portions.

FIGS. 35*a*–35*b* are plan views of a further buckle embodiment showing two flat relatively interengageable buckle members having angularly shaped hook portions.

DESCRIPTION OF THE PREFERRED EMBODIMENT

Figure 1:
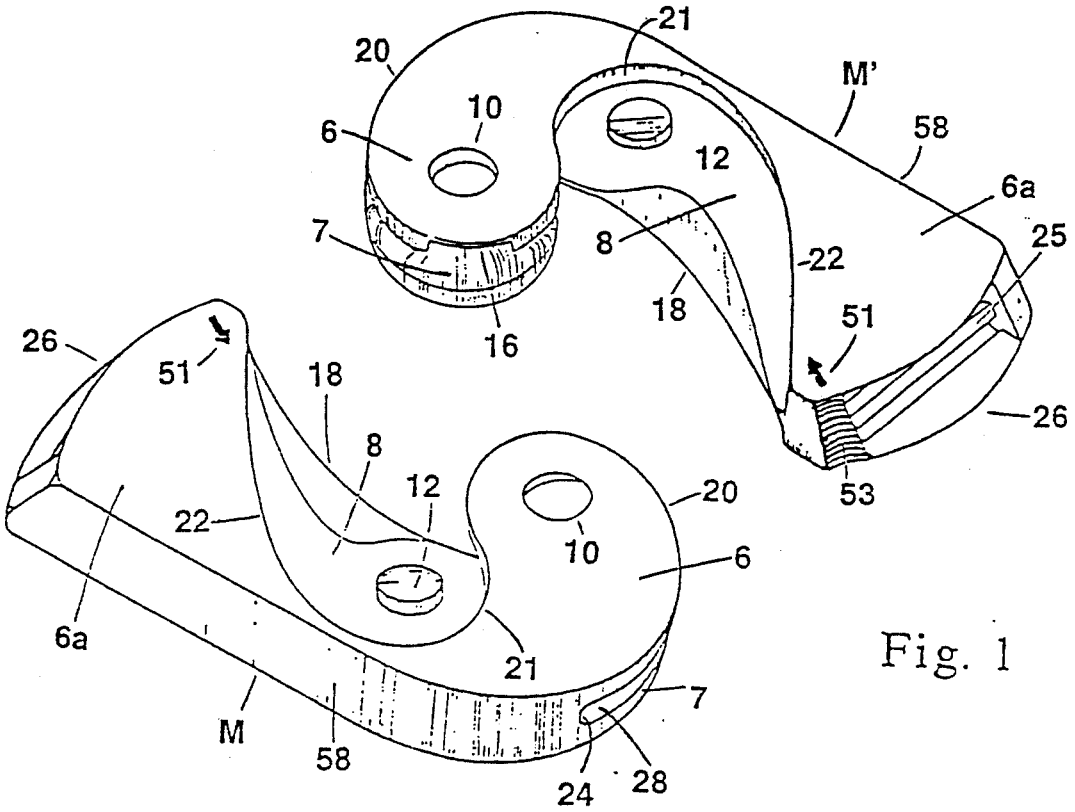
FIG. 1 is a perspective view of the two identical buckle members which comprise the assembly of the preferred embodiment.
Figure 2:
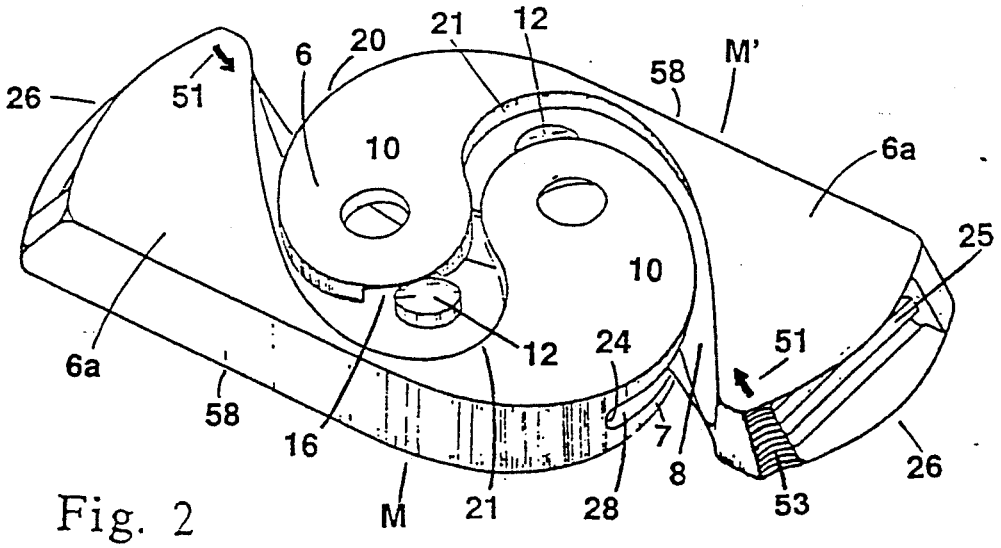
FIG. 2 is a perspective view of the two identical members of the preferred embodiment oriented relative to one another as they would be just prior to their being fastened together and showing the latching pegs and holes on one side of each member.
Figure 20:
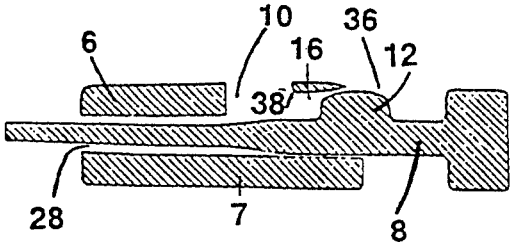
FIG. 20 is a cross section taken at C—C of FIG. 13.
Figure 21:
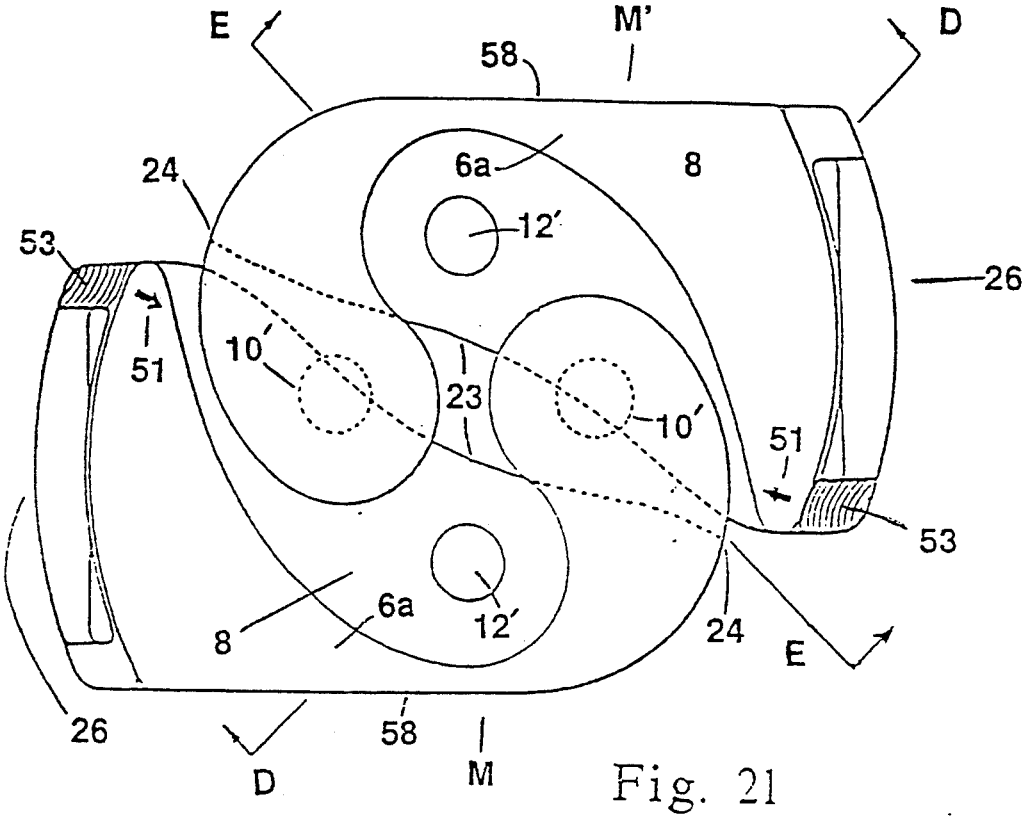
FIGS. 21, 22 and 23 are plan views of two members of an alternative embodiment showing a sequence as the buckle members are moved into engagement and further showing detail of the function of the edge of the web as a guide surface.
Figure 22:
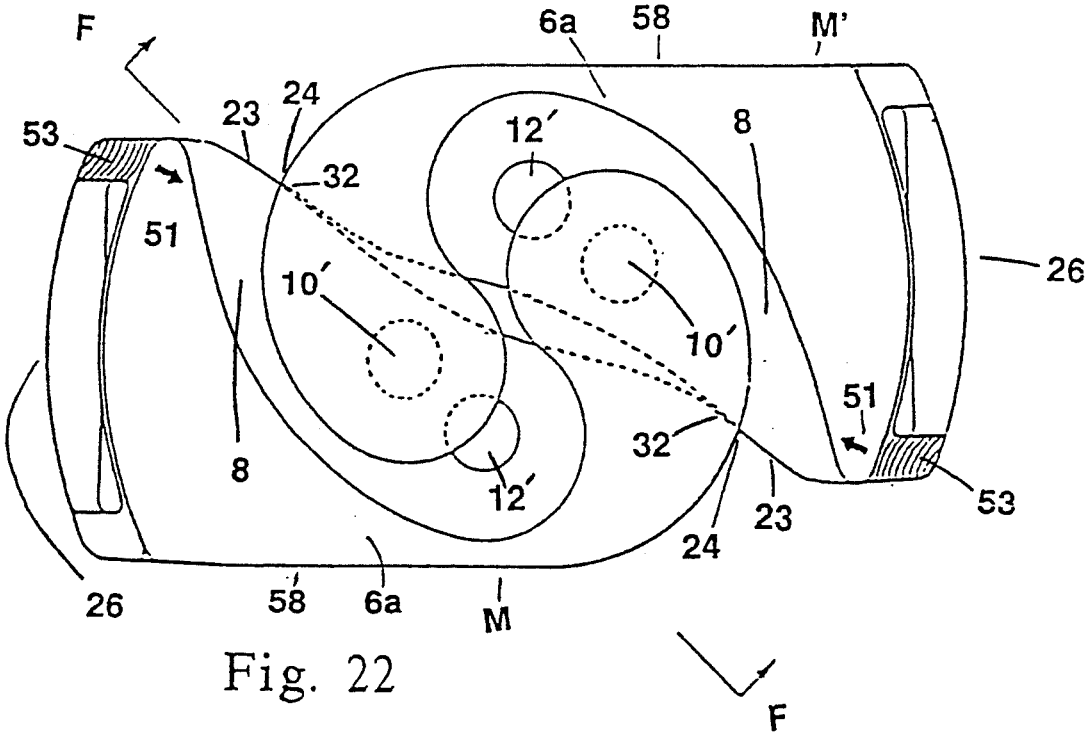
Figure 23:
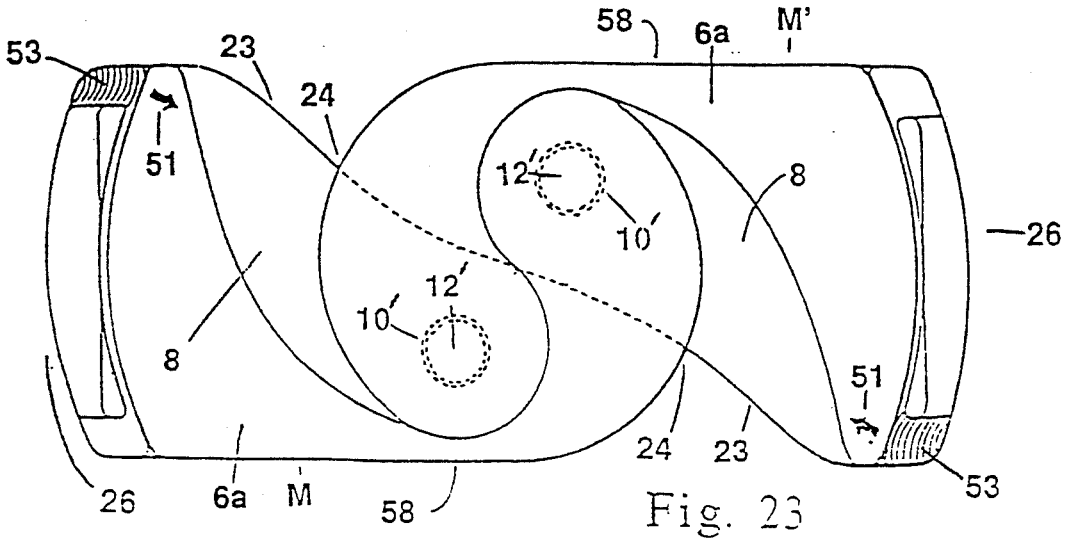
Figure 24:
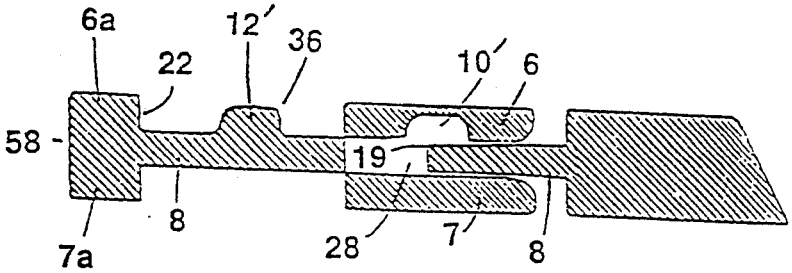
FIG. 24 is a cross section taken at D—D of FIG. 21.
Figure 25:
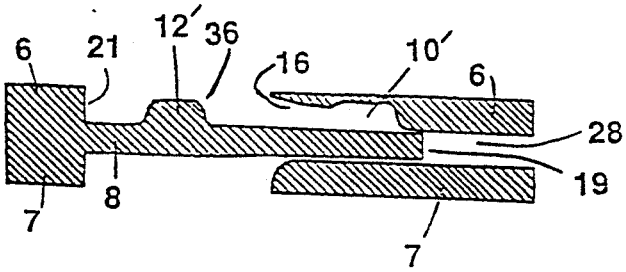
FIG. 25 is a cross section taken at E—E of FIG. 21.
Figure 26:
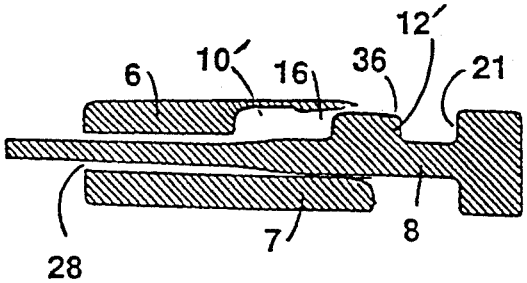
FIG. 26 is a cross section taken at F—F of FIG. 22.

The preferred embodiment of the present invention is a buckle assembly which consists of two identical mating members M and M' shown in FIG. 1. Since the members are identical, this description refers to only one member, with the understanding that the features of the corresponding mating member are identical. Each member incorporates two generally flat hook shaped portions 6 and 7 in parallel planes or strata and spaced apart from each other so as to allow them to straddle and sandwich a center web portion 8 of the identical mating member when the two members are engaged. Each hook portion 6 or 7 has a base portion, 6*a* or 7*a* respectively, which is generally coplanar with its corresponding hook portion. When the buckle members are engaged the hook and base portions 6 and 6*a* of the members are coplanar in a first stratum, the hook and base portions 7 and 7*a* are coplanar in a second stratum parallel to the first and separated from the latter by a stratum formed by the coplanar web portions 8. The abutting surfaces of the hook portions 6 and 7, which resist tension forces longitudinally of the buckle structure when the hooks are engaged, have supporting portions extending to the base portions 6*a* and 7*a* in the respective strata of the hooks. The strata thicknesses are each defined by parallel planes corresponding in position to upper and lower edges of the respective abutting surfaces of the hooks. Hook portion 6 has a hole or aperture 10 or concavity 10' which engages with peg 12 or a convex portion 12' of the opposite member, the interfering surfaces of these parts providing a positive latching means which prevents the two members from inadvertently separating. Hereinafter, all elements of an alternative embodiment of FIGS. 21–26 which directly correspond to or replace an element of the preferred embodiment are noted by a prime(') designation corresponding to the numerical designation without the prime(') as used in reference to the preferred embodiment. The inner face of apertured hook portion 6 has a cutaway channel 16 to facilitate springing apart of the hooks and passage of the peg 12 under hook 6 and to guide the peg into engagement with hole 10 as shown in FIG. 1 or concavity 10' as shown by FIGS. 24–26. Hook portion 6 is constructed with some resilience so that as the two members are slid into latched position with one another, hook portion 6 flexes and is displaced slightly, expanding the width of the space 28 between hook portions 6 and 7 and allowing hook portion 6 to slide up and over the peg as shown in FIG. 20 as the members are moved obliquely toward each other until the latching means comprising hole 10 and peg 12 are aligned. At that point the hook portion 6 returns by snapping back to its unstressed shape, drops back into place and latches onto the peg 12 which serves as a latch keeper means by engaging securely with the latching means formed by the edge of the hole 10. Upon this latching the members are prevented from moving relative to one another even if tension on the buckle is relaxed. The peg 12 is preferably configured with a slightly tapered or rounded top edge 36 to facilitate fastening and unfastening of the buckle assembly. The edge 38 of the hole 10 is also preferably somewhat rounded for the same purpose. Alternatively, where maximum security in latching the fastened buckle assembly is desired, the edges of the peg 12 and hole 10 latching means which abut each other when the buckle assembly is fastened and latched, and which are closest to the inner edge 21 of the hook of the portion bearing the peg 12, are made with well defined right angled edges in place of the rounded edges. This alternate configuration provides for ease of fastening of the buckle assembly without compromising the security of the latching means when the assembly is fastened.

Figure 18:
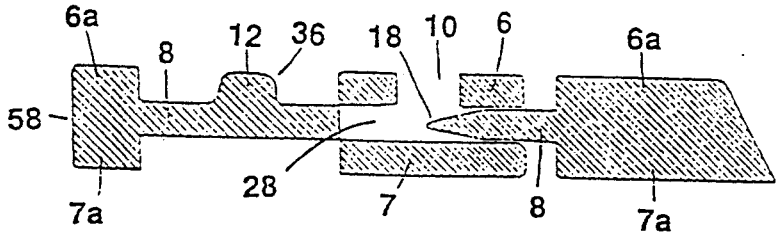
FIG. 18 is a cross section taken at A—A of FIG. 17.
Figure 19:
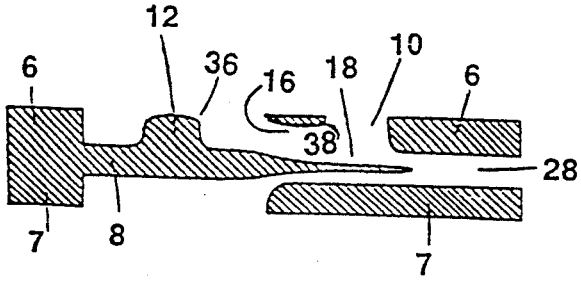
FIG. 19 is a cross section taken at B—B of FIG. 17.

When the hook portions 6 and 7 of mating members are engaged, the hook portions of each member snugly straddle the web portion 8 of the mating member. Because of this snug fit, the members are prevented from moving relative to one another in a direction perpendicular to the planes of the hook portions. Similarly, the engagement of hooks 6 and 7 themselves prevents any movement transverse to the longitudinal orientation of the buckle assembly, the principal direction along which the tensioning forces are applied by the straps, and parallel to the plane of the hooks. The two members are engaged as shown in the sequence of FIGS. 11 through 16 by positioning the members in generally the same plane with the hook portions 6 and 7 of each member straddling the web 8 of the opposite member. To facilitate such alignment, the web 8 is preferably configured with a tapered edge 18 as shown most clearly in FIGS. 1 and 3 and the cross sections of FIGS. 18 and 19. The members are then moved obliquely toward each other relative to the longitudinal orientation of the straps to be connected. Where maximum strength of the buckle assembly is desired the cross sectional area of the web can be maximized by constructing the web with a squared edge 19 as shown in FIGS. 6, 7, 24 and 25. The thickness and width of the webs 8 throughout substantially the entire length of the buckle members and the direct support thereby of the hook portions out to the longitudinal center of the buckle provide great strength of the buckle in resisting the strap forces because of the large proportion of the transverse dimensions of the buckle, along its entire length, given to the material in the structures supporting the load bearing portions of the hooks.

The curved surfaces of the hook portions which engage each other during fastening and in the load-bearing fastened configuration are curved surfaces of revolution generated by a line perpendicular to the plane of the hook and revolving or moving along the curves shown in the plan views. Thus there is at least line contact between the hook portions as these curved surfaces of revolution slide over each other during fastening movement, and contact of substantial areas of the curved surfaces of revolution after the hooks are engaged. During fastening movement the outer surface areas of the hook portions slide on each other when the hook portions are squeezed together from the side, moving each hook slightly in the direction away from its strap member, until passing an over-center position of contact, as shown at 33 of FIG. 15, where tension on the straps will cause the hooks to slide relatively toward each other, and in the direction of their respective strap members, to their completely engaged positions.

Depending on the relative shapes of the guiding or camming surfaces comprising the edge 19 of the web 8 and the inner base edge 22 of the hook portion, the continuous guiding means for the buckle members to their engaged latched positions may shift from one to the other of these guiding surfaces.

During the process of fastening the buckle assembly, each member must move transversely toward the mating member and in the direction generally away from its respective strap end until the hook portions of each member can pass over center. Each member then continues to move transversely and also slides back slightly toward its respective strap end until the members engage completely with each other.

Figure 3:
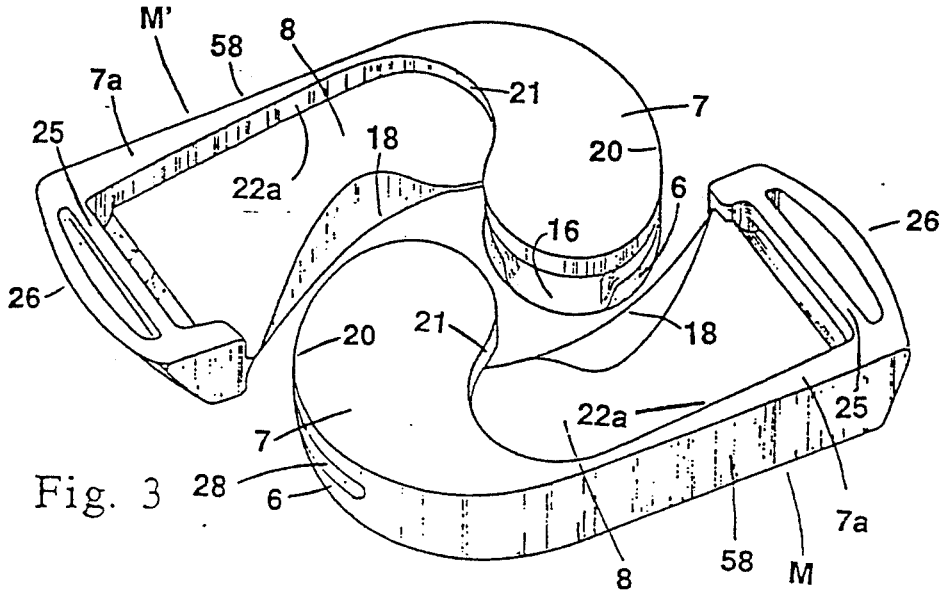
FIG. 3 is a perspective view similar to FIGS. 1 and 2 but showing the opposite side of each member where there are no latching pegs and holes.

As shown, each of the hooking portions 6 and 7 has a continuous surface of curvature comprising an outer edge 20 an inner edge 21 and an inner base edge 22 or **22*a*. As described herein, the outer edge 20 of a hook portion is separated from the inner edge 21 of the same hook portion by a point in FIGS. 4 and 5, which is located at the apex or tip of the hooking portion. The inner edge 21 is a compound curve and extends from the hook apex in FIGS. 4 and 5 to a point which is on the curve of the hook closest to the outer periphery of the buckle member. The curve defined by the inner base edge 22 is coplanar with the curves defined by the inner and outer edges of the hook portion and is generally coplanar with the corresponding hook portion of the mating member. The shape of the inner base edge 22 is such that it cooperates with the outer edge 20 of the mating hook 6 at a line of contact 31 so that as the buckle members are manually squeezed together in a direction parallel to the plane of the hook 6 and transversely or generally perpendicular to the longitudinal orientation of the strap, the inner base edge 22 causes a camming or wedging action against the outer edge 20 of the hook 6 tending to exert a component force in a longitudinal direction relative to the strap and urge the buckle members into complete engagement. As seen in FIG. 3 this function of the cooperation of the outer edge 20 and inner base edge 22 to serve as guiding surface means is not found between inner base edge 22*a* of hook 7 of the preferred embodiment and the outer edge of a corresponding hook of the mating member. In FIGS. 3 and 5 such inner base edge 22*a* is essentially parallel to the adjacent periphery of the buckle member, but could be constructed to correspond exactly to the inner base edge 22** and serve the same function.

Figure 4:
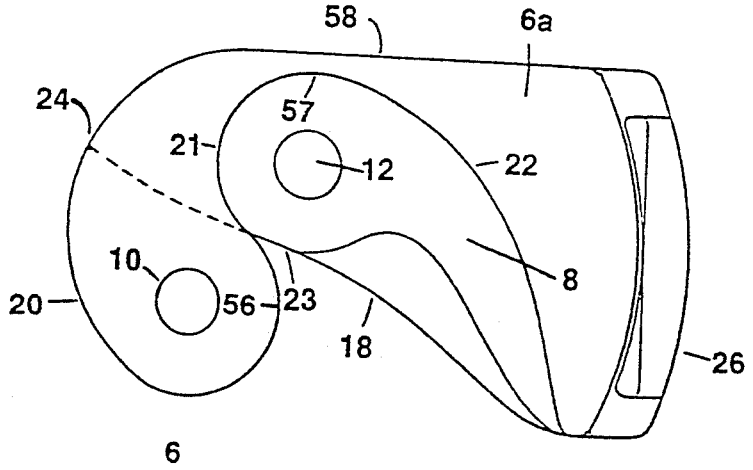
FIG. 4 is a plan view of an individual member of the preferred embodiment showing the peg and hole latching means.
Figure 5:
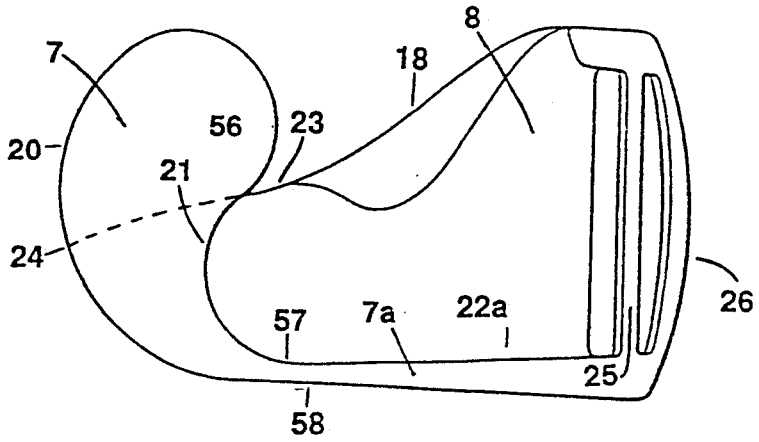
FIG. 5 is a plan view of an individual member of the preferred embodiment showing the reverse face from FIG. 4.
Figure 6:
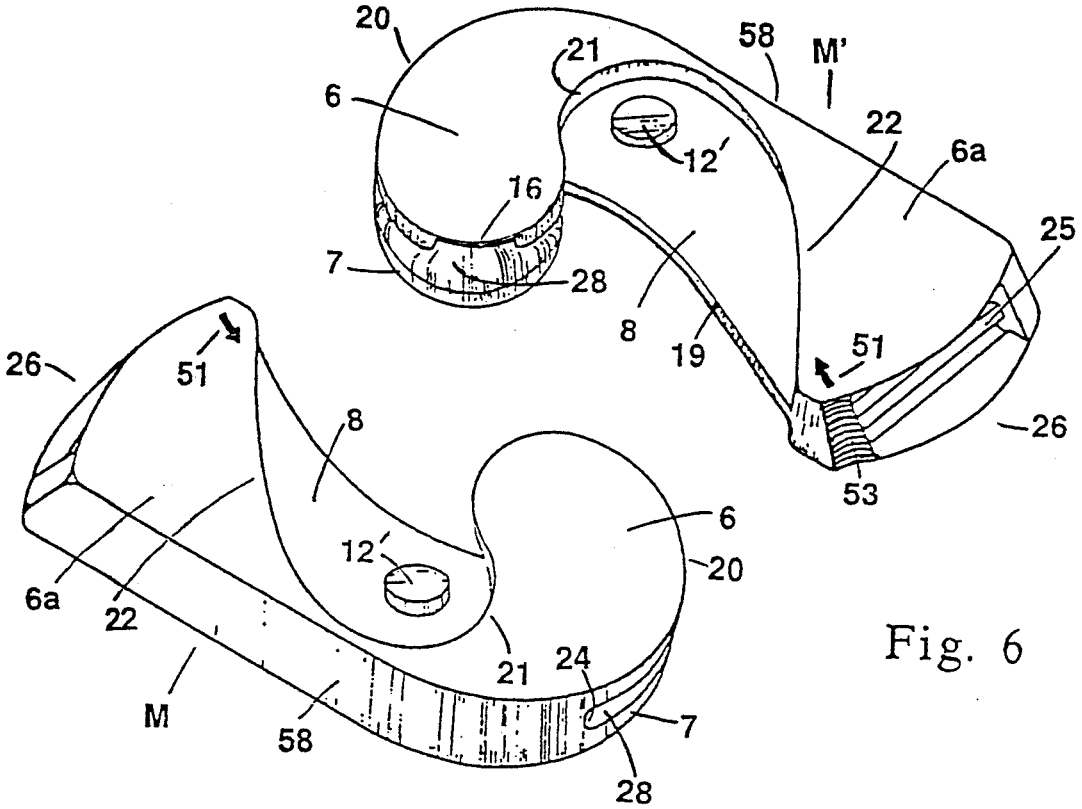
FIG. 6 is a perspective view of the two identical buckle members of an alternative embodiment wherein the edge of the web of the buckle member is left untapered in thickness in order to provide maximum tensile strength and the latching means comprises mating concave and convex surfaces.
Figure 7:
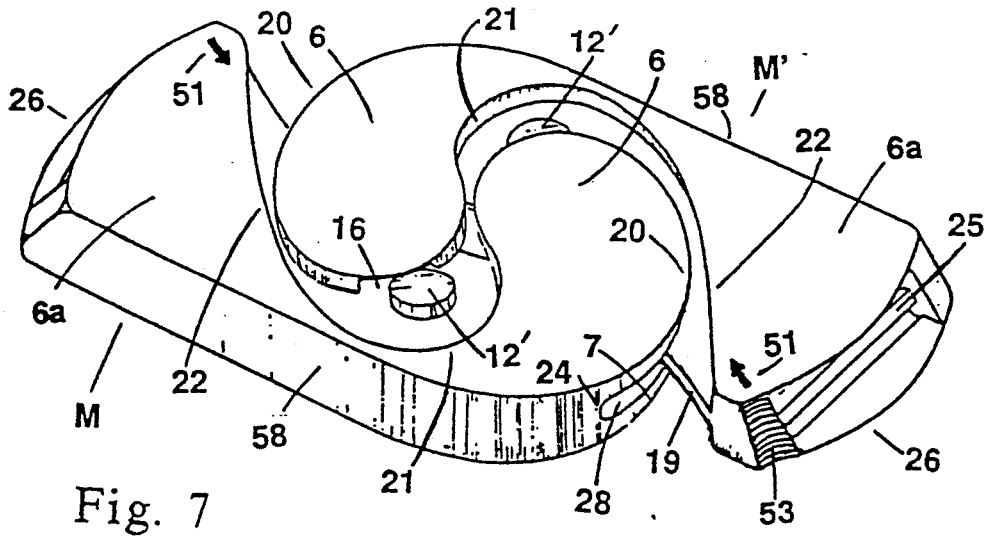
FIG. 7 is a view similar to that of FIG. 2 but showing members of the alternative embodiment of FIG. 6.
Figure 8:
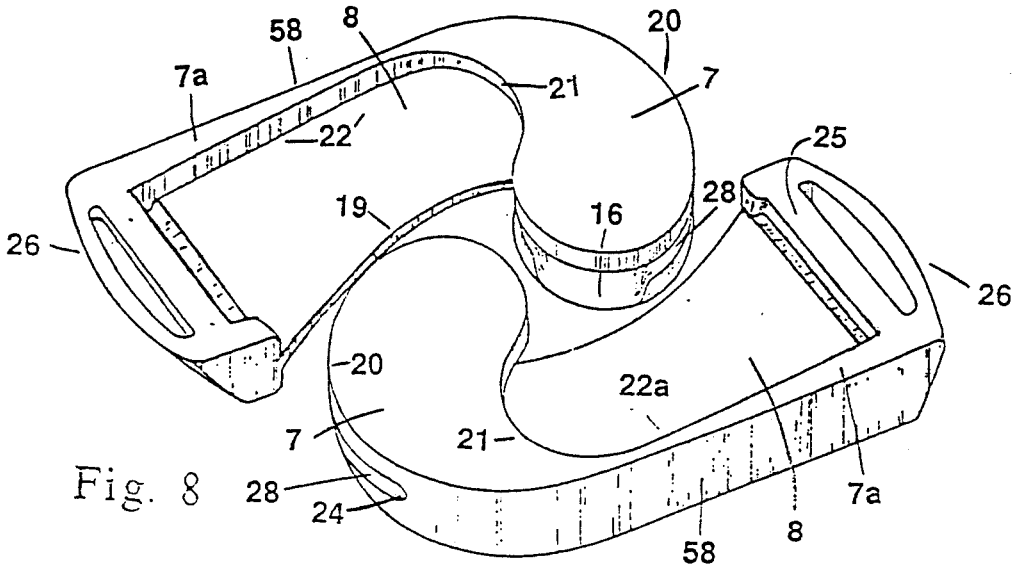
FIG. 8 is a perspective view of the alternative embodiment shown in FIGS. 6 and 7 but showing the reverse face of each member.
Figure 9:
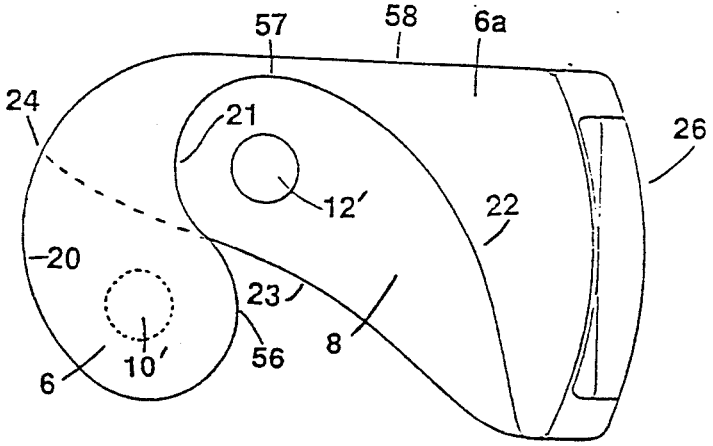
FIG. 9 is a plan view of an individual member of the alternative embodiment of FIG. 6 and 7 showing the convex latching means.
Figure 10:
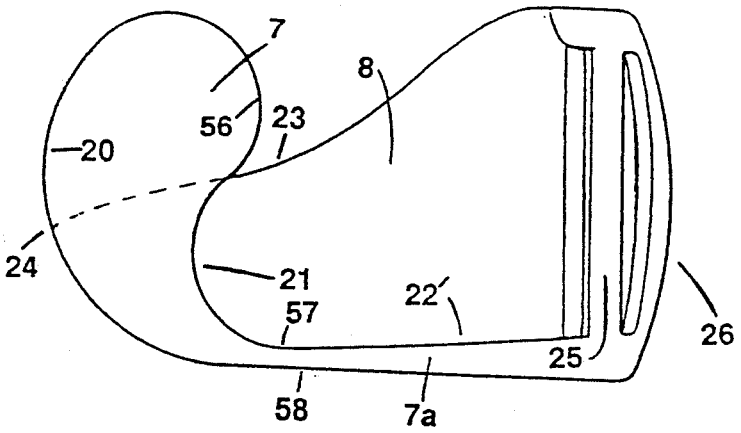
FIG. 10 is a plan view of an individual member of the alternative embodiment of FIG. 6 and 7 showing the opposite face from FIG. 9.
Figure 11:
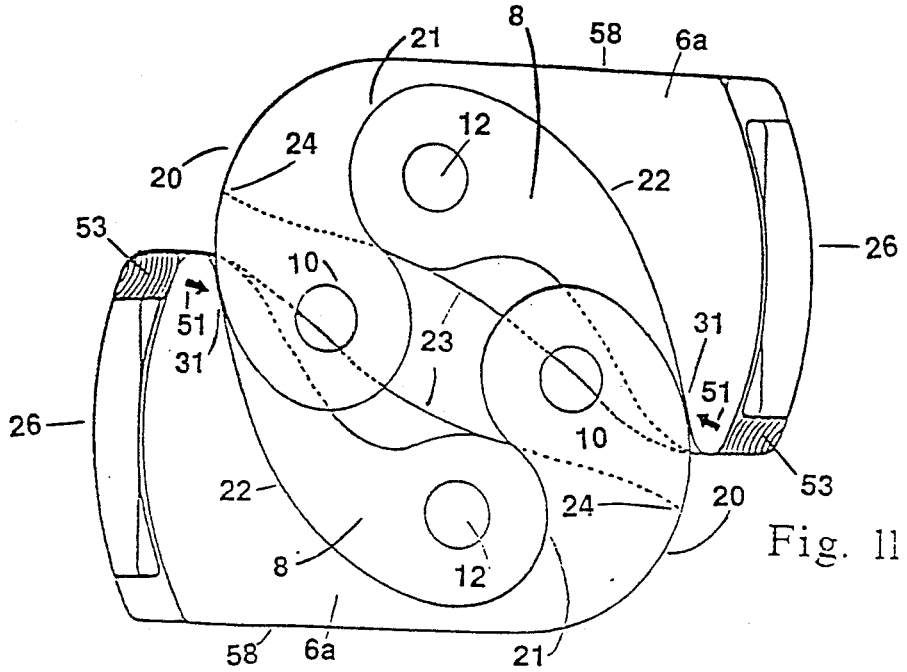
FIGS. 11, 12, 13, and 14, are plan views of two members of the preferred embodiment showing a sequence as the buckle members are moved relatively translationally into engagement.
Figure 12:
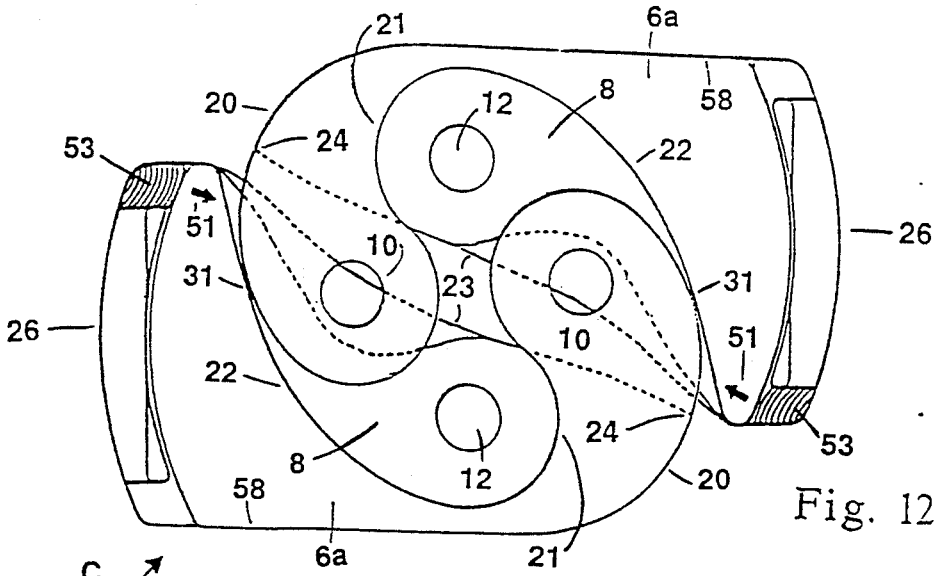
Figure 13:
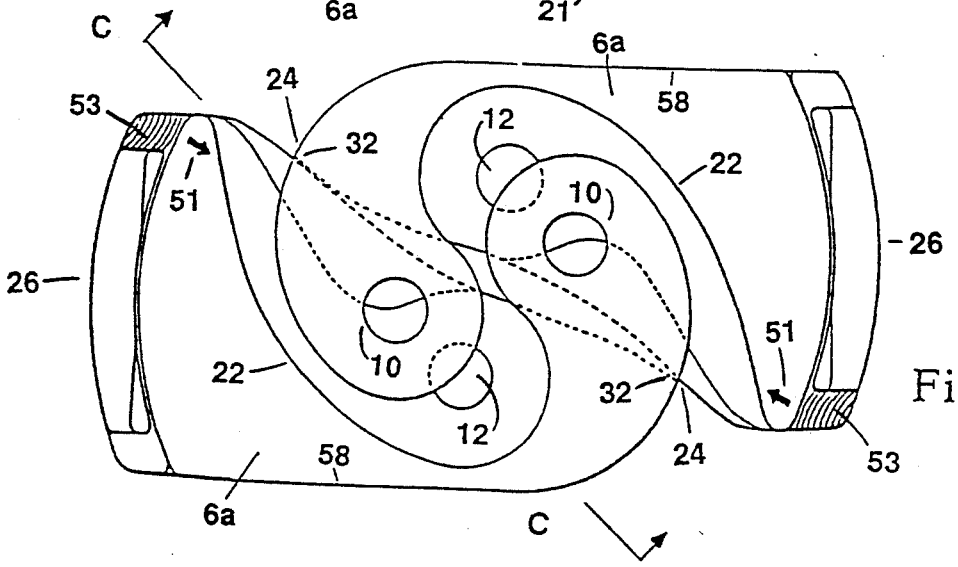
Figure 14:
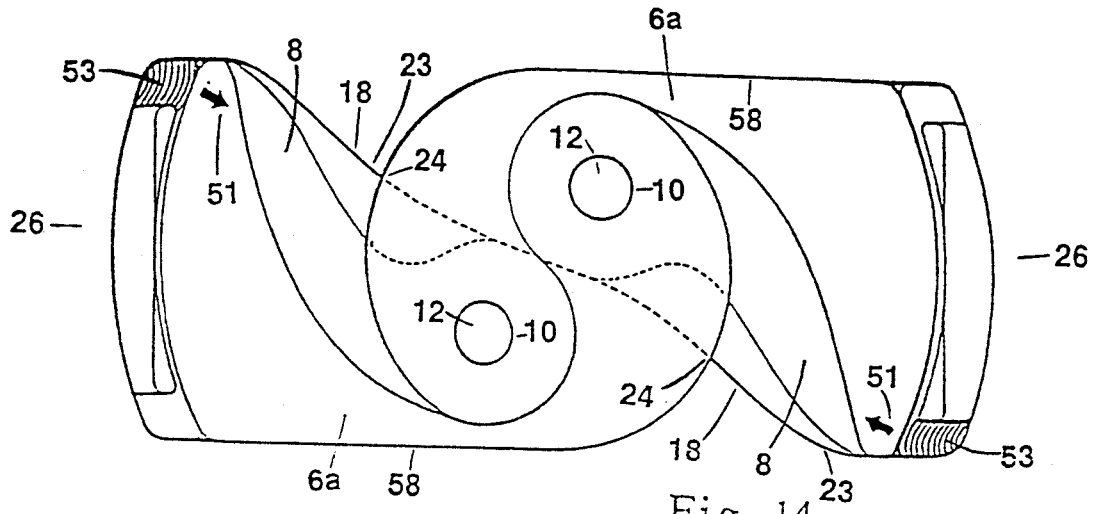
Figure 15:
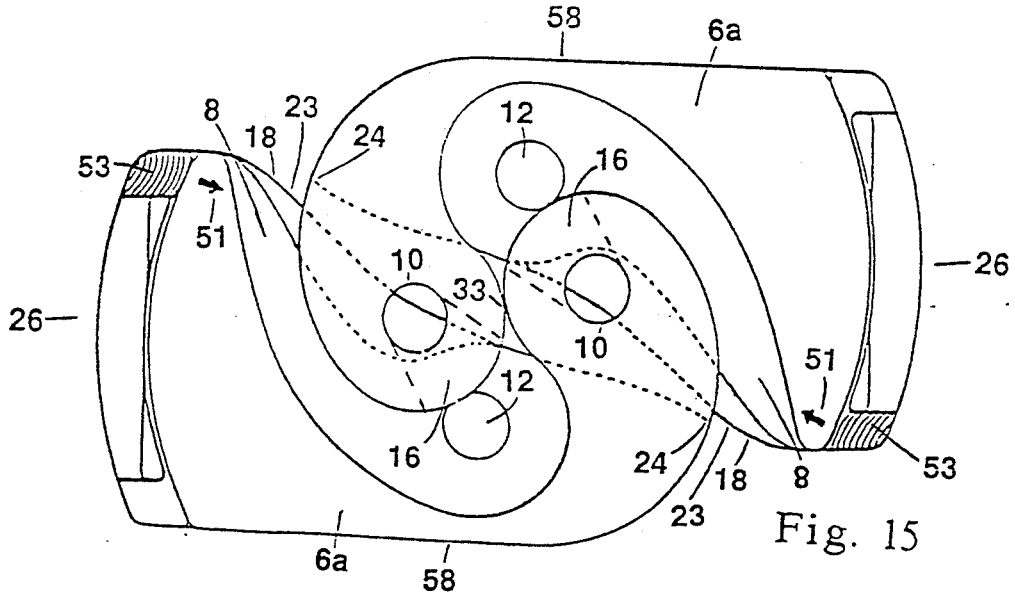
FIGS. 15 and 16 emphasize the function of the inner edge of the hook portions of the preferred embodiment as guide surfaces.
Figure 16:
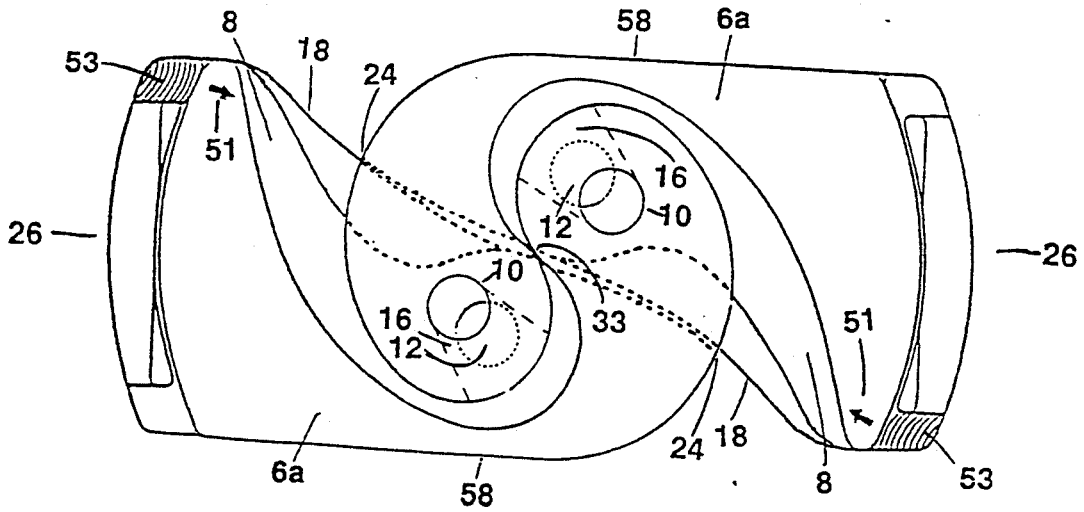
Figure 17:
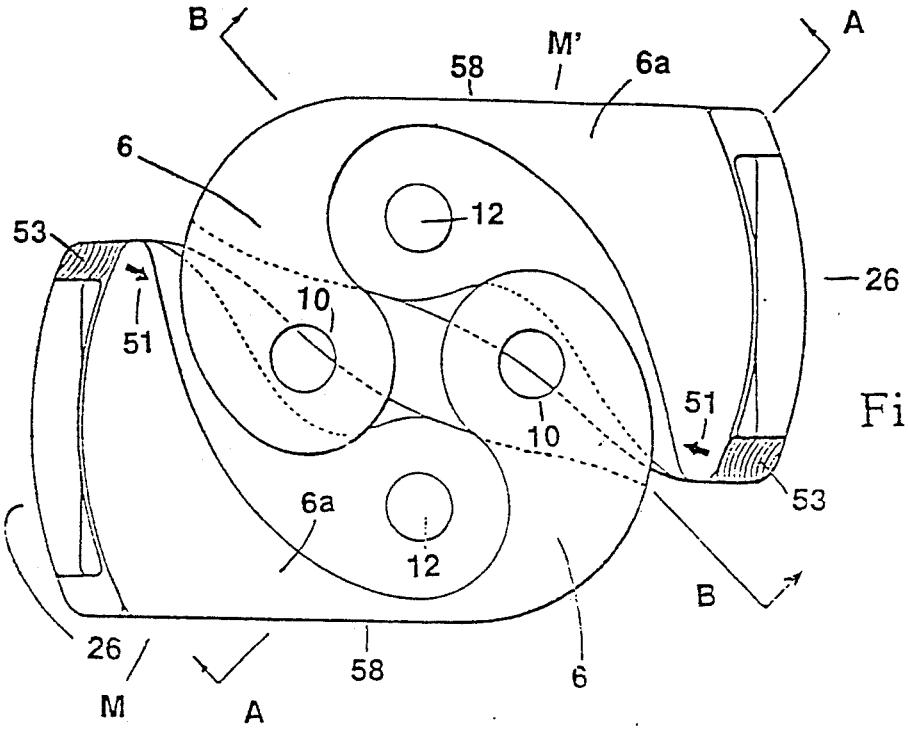
FIG. 17 is a plan view showing the two buckle members of the preferred embodiment in relation to one another before being fully fastened.

Similarly, the edge of web 8 is preferably shaped as shown in FIGS. 3 and 4 with a continuous curve from near one corner of a buckle member angling generally toward a diagonally opposite corner so that its edge forms a second guide surface 23 along the edge of the web portion 8 which cooperates with the extreme forward corner portion 24 on the mating member in the space 28 between hooks 6 and 7 at the end of an extension of the corresponding guide surface 23. A third guide surface means is formed by the contact of the inner edges 21 of hook portions 6 or 7 of the two mating members as shown in FIGS. 15 and 16. Because of the smooth continuous shape of the guide surface created by the shape of the inner edges 21 of interengaging hook portions of the respective buckle members, after initial alignment of the hook portions to an over-center position the buckle members can be pulled together from the strap ends without regard for the actual oblique direction of relative movement necessary to engage the mating hook members and corresponding latch means. Upon initial alignment of the two buckle members in the same plane with the hook ends or tips overlapping slightly in a transverse direction near their point of contact as shown at 33 of FIG. 15, either a lateral squeezing of the two members or an application of longitudinal tension, such as by pulling longitudinally on the strap of each buckle member, causes the wedging or camming action of the guide surfaces, singly or in combination, to guide the hook portions precisely into an engaged latched position. Because of the smooth continuous shape of the guiding surfaces, 22 or 23, this squeezing or pulling can be done without regard for the actual oblique direction of relative movement necessary to engage the mating hook members and corresponding latch means.

While engaged and latched, the security of the fastening of the two members increases with increased tension on the straps. However, when the members are latched together, the members are prevented from moving relative to one another even if tension on the straps is relaxed.

Unfastening of the buckle assembly which uses peg and hole latch means, where the edges of the peg 36 and the hole 38 are squared for security in latching, is achieved by manually grasping each member and twisting clockwise, as seen from the strap looking toward the respective buckle member, along its longitudinal axis so as to tend to lift each hook portion out of engagement with the corresponding peg. In such an embodiment, both hook portions 6 and 7 are preferably constructed with some resilience. During such relative twisting movement between the two members, the web 8 of each member causes a wedging or camming action tending to flex the hook 6 and 7 portions of the opposite member apart, widening the space 28 between the hook portions. The symmetry of the members and the resilience of hook portions 6 and 7 allow such relative twisting of the two members to disengage both sets of holes 10 and pegs 12 equally and simultaneously, thus releasing the latching means. The buckle members are then translationally moved obliquely in relation to one another generally in parallel planes for complete separation of the buckle members. This relative movement is demonstrated by the sequence using FIGS. 14, 13, 12 and 11. In the preferred embodiment, the use of rounded or tapered edges 36 and 38 of the peg 10 and hole 12 latch means respectively allows for release of the buckle assembly using only one hand. Another embodiment for the same purpose incorporates mating concave 10' and convex 12' latch portions as shown in cross section in FIGS. 24. 25, and 26 in place of the peg and hole latch means of the preferred embodiment. Using the structure of either of these latter two embodiments, these mating latching portions can be forced to slide free of each other so that little or no twisting of the mating members is necessary to release the latching means, such release being accomplished instead by, for instance, manually squeezing with the fingers to apply force to the finger engageable indentations 53 on each buckle member from corresponding diagonally opposite corners of the fastened buckle assembly as shown by indicia 51 molded into the surface of each buckle member.

It should be noted that the hole 10 or concave latch portion 10' is shown as being on hook portion 6 while the peg 12 or convex latch portion 12' is shown as being located on web 8. Obviously the respective locations of these mating peg and hole latch portions could be reversed, or the concave and convex portions exchanged. Also, multiple latch means could be incorporated, such as by using latch means as demonstrated herein on each of the two hook portions 6 and 7 with corresponding mating latch means on each face of the web 8 in a manner like that of the embodiments of FIGS. 27–39 described hereinafter.

The guiding surfaces 22 and 23 described above which facilitate fastening of the buckle have a corresponding function in unfastening. For example, upon releasing the latch means, a force applied from the strap end of each buckle member toward the center of the buckle and parallel to the straps, tends to cause the hooks to separate along the direction parallel to the applied force. The shape of each guide surface formed by the inner base edge 22 of a hook portion or by the continuous edge 23 of web portion 8 also causes a wedging or camming action with a component force tending to separate the members transversely as well, providing for complete release of the buckle as shown by the sequence demonstrated using FIGS. 14, 13, 12 and 11.

The portion of each buckle member to which a strap is fastened or secured as at 26 can be configured in any of a number of ways well recognized in the relevant art. For example, a strap can be permanently fixed by sewing a strap end in a closed loop around a generally elongated transverse portion of a buckle member. More commonly, the strap attaching means allows for lengthwise adjustability of the strap by incorporating a well recognized structure which utilizes two parallel transverse rod elements lying generally in the plane of the strap and located at the strap end of the structure of each buckle member, the strap passing initially generally along one side of a first rod element at the end 26 of the buckle member then looping around the second rod element 25 in an elongated aperture near the end 26 and back between the strap itself and the first rod element. The loose end of the strap is thus frictionally secured between the first rod element and the load bearing portion of the strap. As illustrated in the drawings the strap attaching portions at each end 26 are merely representative. A simple transverse elongated aperture as shown at 125 and 225 in the embodiments of FIGS. 27–39 may also be used with a strap or belt passing therethrough and looped and stitched back upon itself in a manner well known. In a buckle as described herein, such strap attaching portions would be designed and sized to achieve a strength commensurate with the load intended to be borne by the buckle assembly.

The present invention is well suited toward construction from any of a number of materials. In the preferred embodiment a suitable material would be any which is easily shaped by injection molding and is relatively stiff yet sufficiently resilient to allow slight springing deflection of the two hook portions of one member away from each other. A typical plastic with these properties is acetal resin which is sold by the Dupont Chemical Company under the trade name Delrin. For applications where particular high strength of the buckle might be desirable, other suitable materials might consist of high tensile strength metals or of fiber reinforced plastic such as an epoxy resin reinforced with high strength carbon fibers.

The strength of the hook portions resisting the loading forces applied to the ends of the buckle structures by the straps being interconnected by the buckle is substantially greater than the strength of the hole and peg latching means to a degree that the load bearing capability of the buckle is essentially independent of the strength and operation of the latching means. The force required to bend the apertured hook portion 6 transversely to slide over the latching peg 12 is also substantially less than typical load forces. This is in part due to the thickness of the apertured hook portion 6 and partly due to the absence of material both at the hole and at the cutaway channel 16. The non-apertured hook 7 can be made even more relatively stiff, i.e., not only stronger against load bearing tension, but also more resistant to transverse bending in the direction away from hook 6, than the apertured hook portion 6 in several ways. It may be reinforced internally by high strength fibers or it may be made thicker than the apertured hook portion.

Although the preferred embodiment described above utilizes translational movement to fasten and unfasten the buckle members, the specific construction thereof does not permit direct end-to-end translational movement for such fastening and unfastening. However, by making the flat hook portions of one of the buckle members of substantially increased load carrying capacity, these hook portions can be given more freedom of flexing movement generally perpendicular to the planes of their latched positions to enable them to slide over the hook portions of the other member. Thus, due to their increased resilient movement, they are able to not only rise slightly over the latching peg as previously described, but they can be provided with interfering surface means such as beveled edges to force these hook portions further apart for sliding movement over the hook portions of the other member during intermediate parts of their ranges of end-to-end movement from disengaged to fully latched positions.

Such end-to-end fastening is achieved in the alternative embodiments of the invention described in connection with FIGS. 27–39. In the embodiment of FIGS. 27–33 there is a great similarity of the buckle configuration with that of the preferred embodiment. Parts with similar or closely related functions or structures are identified with similar numbers which are 100 higher than in the earlier figures.

The structure of each buckle member 101 and 102 comprises three flat laminae each of similar thickness and having spaced broad flat parallel surfaces. All three laminae have strap or belt accommodating transversely extending registering apertures at the strap receiving end of the member. The central lamina is a web-like lamina having opposite faces 108 and a first edge 119 providing a camming or guiding function to be described. On the opposite faces 108, the center lamina has raised pegs or protuberances 110 received within apertures 112 in end portions of hooks 106 of the opposite buckle member to form a latching means to hold the members together when they assume the latched positions of FIGS. 30 and 33. The other side of the center lamina has a shape with a curved edge conforming to the outer edge of each of the lamina which form the hooks 106.

As seen in FIG. 27, the end of one of the hooks 106 of the buckle member 101 is in position to slide over the upper surface of the upper mating hook portion 106 of the other buckle member 102. The hooks 106 are formed of resilient tensionally-strong material and have portions forming stems 126 which support the engageable hook end portions from a base structure near the belt-attaching means at the aperture 125. The stems have sufficient length unattached to, the center lamina to permit the necessary deflection for the hook end portions of buckle member 101 to slide over the structure of the other buckle member 102. The hooks have opposed edges with undercut beveled edges 114' on buckle member 101 and outwardly exposed beveled edges 114 on buckle member 102. When the members 101 and 102 are manually forced together end-to-end, the surfaces 114 force the surfaces 114' apart and the end of member 102 can slide between the hook portions of member 101. The beveled surfaces 114 and 114' extend over large arcs at the edges of the hooks enabling sliding engagement of the members even with some misalignment of the buckle members. However, the buckle members can be pushed together until the straight edges 119 of the central web-like lamina come into engagement. In the position shown in FIG. 27 the ends of the hooks on member 102 would be about to pass into a straddling relationship with the web lamina of member 101. To assure that the edges of these hooks pass more easily over the pegs 110 on member 101, the surface of the pegs 110 first encountered by the hook edges may be slightly rounded, similarly to the rounding describe for the preferred embodiment. When the ends of the hooks on member 101 snap back together after the guiding surfaces 119 on the two buckle members engage, the user knows that these ends have fallen behind the other hooks and tension is then applied to assure that the pegs 110 register in latching engagement with the holes 112. Such tension causes the surfaces 121 to act upon each other to force the latching parts toward their engaged positions as indicated for the preferred embodiment. If the edges 119 engage before the hooks ends fall beyond the opposing hooks, further end-to-end movement results in the surfaces 119 guiding the hook ends so that the holes therein will snap down directly over the pegs 110.

The guiding or camming surfaces 119 and 122, like the surfaces 219 and 222 of embodiments described hereinafter, cooperate with surfaces on the center or outer laminae of the opposing buckle member so the members can be forced into disengagement by a continuation of movement of the buckle members toward each other in a manner similar to that described for the preferred embodiment of the invention.

It should also be noted that the embodiments of FIGS. 27–39 are each capable of being moved into latched engagement without spreading the resiliently separable hooks by relative translational movement of the buckle members transversely of the longitudinal direction of the buckle's tension resisting action in addition to the end-to-end movement of the members for their latched engagement. Thus it will be apparent that because of the distinct end-to-end and transverse relative movements selectable for engaging the buckle members and the similar mutually distinct disengaging movements, the user has a choice for unfastening movement which may be other than merely a reversal of fastening movement and in a direction distinct from the direction opposite from the fastening direction.

The alternative embodiments of the invention shown in FIGS. 34–39 function in essentially the same manner as that in FIGS. 27–33. Similarly functioning parts have numbers 100 higher than those in FIGS. 27–33 and 200 higher than those of the preferred embodiment. The primary differences are: (1) the hooks of the buckle members do not extend as far across the width of the buckle members and have an angular configuration with straight sides parallel to their direction of end-to-end movement into engagement, (2) the relative positions of the pegs 210 and holes 212 of the latching means are somewhat changed, and (3) in FIG. **35*a* the tips of the hook portions overlie and are bonded to or integral with a portion of the center web stratum or lamina at the area 224** to strengthen this portion of this buckle member.

Figures 36A, 36B, 37, 38, 39:
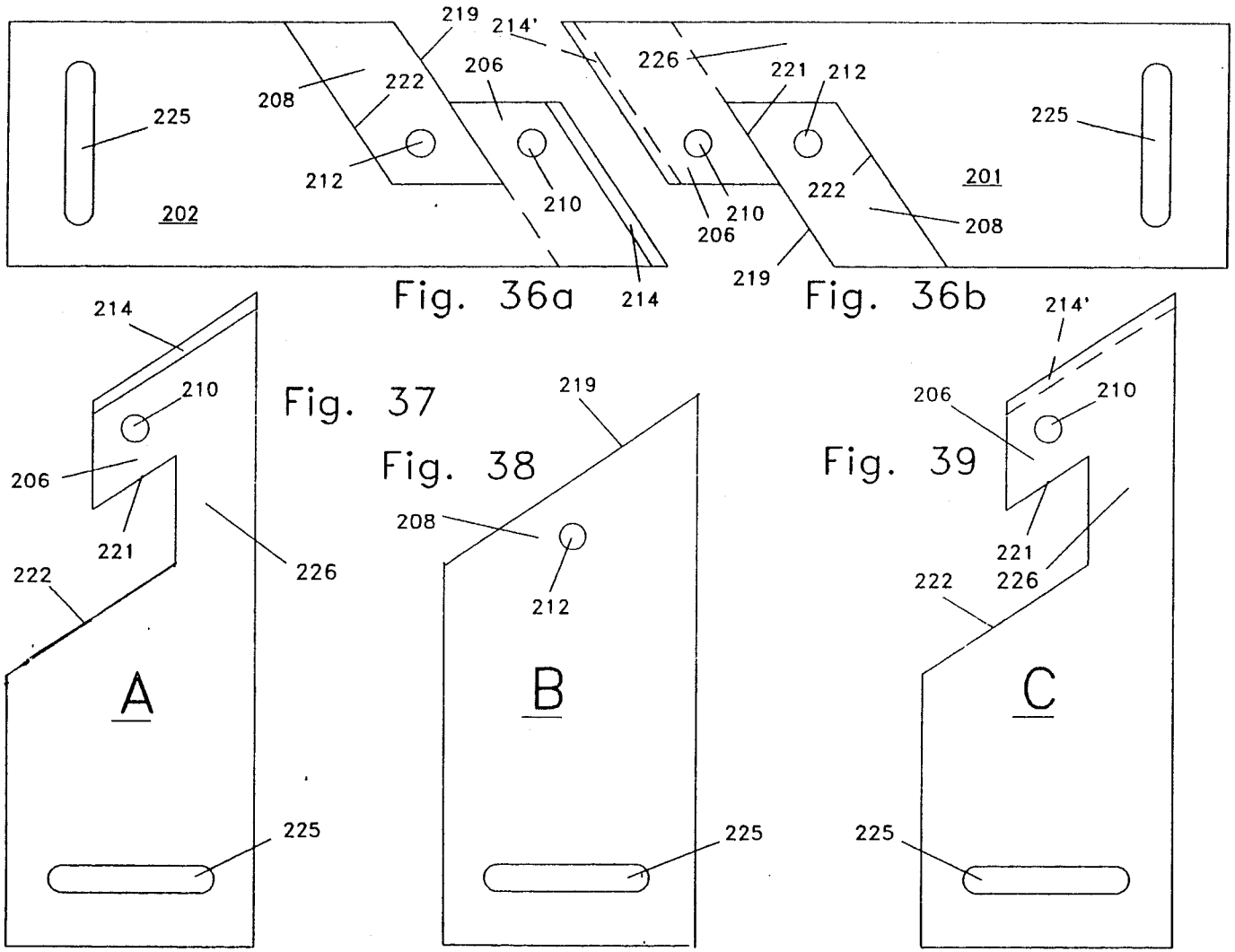
FIGS. 36*a* and 36*b* are plan views of still another buckle embodiment showing two flat relatively interengageable buckle members having angularly shaped hook portions.
FIGS. 37–39 are plan views of three separate strata or laminae A, B and C which are stacked with C on top of B and with A behind B to form the laminated structure of FIG. 36*b*, and with reversal of the relative positions of C and A vis-a-vis B. the structure of FIG. 36*a* can be formed.

In FIGS. 34*a*–34*b* and 35*a*–35*b* the pegs 212 and holes 210 are spaced from the tips of the respective hook parts, whereas the locations of the pegs 212 and holes 210 in FIGS. 36*a*–36*b*, although directly along the center of the buckle members, are closer to the tips of the hooks. Although the beveled surfaces 214 and 214' are shown extending all the way across the straight angled ends of the hooks 206, there is no need to have these beveled surfaces extend laterally beyond the opposing hook ends except to accommodate some initial misalignment of the buckle members when they are being moved into engagement. By means of the guiding or camming surfaces 219 and 222 the hooks 206 and latching means 210, 212 are guided into or out of engagement as previously described.

Except for the location of the hole 210 in the embodiments of FIGS. 34*a*–39, the outer hook portions of these buckle members can be made from two hook laminae which differ only in the location of the bevel 214 or 214'. FIGS. 37–39 are plan views of three separate strata or laminae A, B and C which are stacked with C on top of B and with A behind B to form the laminated structure of FIG. 36*b*. By reversing the relative positions of C and A vis-a-vis B, the structure of FIG. 36*a* can be formed. This same feature can be achieved with the structure of FIGS. 27–33. Of course, if the buckle members with the relatively fixed outwardly beveled edges have their respective strata molded together as one piece, this feature is inapplicable.

In all of the embodiments of FIGS. 27–39 the buckle member with the slightly separable resilient hooks can be made by bonding three laminae like those of FIGS. 37–39 of resilient tensionally-strong material together in the facing or abutting areas thereof surrounding the apertures 125 or 225. The hook end portions are supported by means including stems 126 or 226, unattached to the center lamina, extending between these hook ends and the bonded area at the apertures 125 or 225. The extent of such bonding depends upon the configuration of the buckle parts and upon the bendability and resiliency of the resilient hook portions. Sufficient deflection of the ends of the hooks must be possible to allow them to slide over the relatively fixed hook ends which do not spring apart. The stem portions 126 and 226, which are not bonded to the center lamina, provide essentially the entire resistance to tension forces in those fastened buckle members where the hook portions are resiliently separable to slide over the other mating buckle members.

Other variations within the scope of this invention will be apparent from the described embodiments and it is intended that the present descriptions be illustrative of the inventive features encompassed by the appended claims.

What is claimed is:

1. A buckle for connecting two belt-like parts and for resisting a tension force applied by said parts tending to separate said parts along a principal direction of said tension force, said buckle comprising a first flat member and a second flat member, each of said members having an end to which a belt-like part can be attached, each of said members having two flat tension resisting structures in separate respective first and second strata of the buckle, each structure having in each respective stratum a surface portion extending transversely with respect to the direction of the tension force and abutting a corresponding transversely extending surface portion on the structure in the respective stratum of the other member to resist said tension, the abutting surfaces in each stratum having upper and lower edges corresponding in position to two spaced inner and outer parallel planes defining the respective strata, each buckle member having as part of its tension resisting structure supporting portions directly supporting said abutting surfaces and extending from each said abutting surface toward said end of the respective buckle member, each of said supporting portions lying within one of said two strata, said members having latch means comprising cooperating interfering surfaces to positively retain said members against inadvertent separation to an unbuckled position when said tension force is released, at least one of said interfering surfaces providing resilient displaceable retaining means for engaging the cooperating interfering surface of the other member and resiliently urged to a position for such cooperating interference to permit engagement of the buckle members by essentially only relative translational movement of said members, said parts being moveable to their disengaged positions by manipulation of the buckle members relative to each other to force the displacement of said retaining means and enable unbuckling of said buckle members.

2. A buckle according to claim 1 where the tension resisting structures of the two members are similar flat interengaging hook portions in each stratum and the latch means comprise a said resilient displaceable retaining means on each said member.

3. A buckle according to claim 1 where the two members are identical.

4. A buckle according to claim 1 where the tension resisting structures of each stratum comprise interengaging essentially coplanar hooks.

5. A buckle according to claim 1 where the tension resisting structures of each member have two hook portions in spaced parallel strata, the hook portions of at least one member straddling a portion of the other member, one of said last mentioned hook portions comprising the interfering surface of the latch means of the respective member and the interfering surface of the latch means on the other member being on the straddled portion thereof.

6. A buckle according to claim 5 where the tension resisting structures of the two members are similar interengaging hook portions and the latch means comprise a said resilient displaceable retaining means on each said member.

7. A buckle according to claim 5 where the two members are identical.

8. A buckle according to claim 5 where the portion of the member which is straddled has an edge and such edge is tapered in thickness to facilitate insertion of the straddled portion of the other member and alignment of the two members for engagement.

9. A buckle according to claim 5 where each member has a straddled portion between the hook portions of the other member, each straddled portion has an edge, each such edge being shaped to provide a continuous surface which interacts with at least one point of a corresponding surface on the mating member to provide a guide, such guide causing the mating buckle members to slide into full engagement when such members are mutually squeezed together.

10. A buckle according to claim 5 where each member has at least one base portion generally coplanar with its corresponding hook portion, each base portion has an inner edge, such edge being shaped to provide a surface which interacts with the outer surface of a corresponding hook portion on the mating member to provide a guide, such guide causing the mating buckle members to slide into full engagement when the buckle members are manually squeezed together.

11. A buckle according to claim 5 where at least one hook portion of each member has an inner edge, such inner edge is shaped to provide a surface which interacts with the inner edge of a corresponding hook portion on the mating member to provide a guide means, and such guide means creates a wedging action causing the mating buckle members to slide into full engagement when such members are subjected to tension applied from their respective ends to which belt-like parts can be connected.

12. A buckle according to claim 1 wherein the interfering surfaces of the latch means comprises a combination of a recessed portion on one member and a mating generally convex portion on the other member.

13. A buckle according to claim 1 wherein the interfering surfaces of the latch means comprises a combination of a hole on one member and a mating protrusion on the other member.

14. A buckle comprising two interengaged buckle structures for resisting tension forces applied to respective ends of the two buckle structures and in opposite directions along a primary direction along which the buckle can interconnect two members which apply said tension forces, each structure comprising a first and a second flat engagement part, said first engagement parts being engaged to resist such tension forces and lying in a first stratum, said second engagement parts being engaged to resist such tension forces and lying in a second stratum parallel to said first stratum, said engagement parts being movable to their engaged position by only relative translational movement of said structures parallel to said strata, each said stratum being limited in thickness to the thickness of the opposing engaging faces of said engagement parts, which faces are generally perpendicular to said strata said parts each having a supporting portion extending from a respective engagement face toward said end of the respective buckle structure and partially surrounding an opposed engaging face of the other structure, and releasable latch means comprising interengageable portions with one such portion on each of said structures, said interengageable portions being engaged when said structures are interconnected to retain said structures against inadvertent unbuckling when said tension forces are relaxed.

15. A buckle according to claim 14 wherein said structures include cooperating camming surfaces whereby said interengageable portions of said latch means are forced into their engaged positions by manual translational movement of said structures toward each other and parallel to said strata.

16. A buckle according to claim 14 wherein said engagement parts and said interengageable portions are moved into engagement by relative translational movement of said structures toward each other and transversely of said primary direction and parallel to said strata.

17. A buckle having a flat configuration and comprising two interengaged buckle structures for resisting tension forces applied in opposite directions along a primary direction of the tension forces and along which the buckle can interconnect two members, each of said structures having an end for securing it to a respective one of said two members to be interconnected, each structure comprising a first and a second flat hook, said first flat hooks being of like thickness and engaged and hooked together to resist such tension forces and lying in a first stratum corresponding in thickness to the thickness of said first hooks, said second flat hooks being of like thickness and engaged and hooked together to resist such tension forces and lying in a second stratum corresponding in thickness to the thickness of said second hooks and parallel to said first stratum, the engaged first hooks having a pair of abutting surfaces, the engaged second hooks having a pair of abutting surfaces, the abutting surfaces of each pair of abutting surfaces in each respective stratum having upper and lower edges corresponding in position to two spaced inner and outer parallel planes defining the respective strata, each buckle structure having, as part of its tension resisting structure, supporting portions directly supporting each of said abutting surfaces and extending from each said abutting surface toward said end of the respective buckle structure, each of said supporting portions lying within one of said two strata, said flat hooks being movable to their engaged position by only relative translational movement of said structures parallel to said strata, and releasable latch means comprising interengageable portions with one such portion on each of said structures, said interengageable portions being engaged when said structures are interconnected to retain said structures against inadvertent unbuckling when said tension forces are relaxed.

18. A buckle according to claim 17 wherein said structures include cooperating camming surfaces whereby said interengageable portions of said latch means are forced into their engaged positions by manual translational movement of said structures toward each other and parallel to said strata.

19. A buckle according to claim 17 wherein said flat hooks and said interengageable portions can be moved into engagement by only relative translational movement of said structures toward each other and parallel to said strata, said movement including a principal relative movement of said hooks transversely relative to said primary direction.

20. A buckle having a flat configuration and comprising two interengaged buckle structures for resisting tension forces applied in opposite directions along a primary direction of the tension forces and along which the buckle can interconnect two members, each structure comprising a first and a second flat hook, said first flat hooks being of like thickness and engaged and hooked together to resist such tension forces and lying in a first stratum corresponding in thickness to the thickness of said first hooks, said second flat hooks being of like thickness and engaged and hooked together to resist such tension forces and lying in a second stratum corresponding in thickness to the thickness of said second hooks and parallel to said first stratum, said flat hooks being movable to their engaged position by only relative translational movement of said structures parallel to said strata, and releasable latch means comprising interengageable portions with one such portion on each of said structures, said interengageable portions being engaged when said structures are interconnected to retain said structures against inadvertent unbuckling when said tension forces are relaxed, said flat hooks and said interengageable portions being movable into engagement by only relative translational movement of said structures toward each other and parallel to said strata, said movement including a principal relative movement of said hooks transversely relative to said primary direction.

21. A buckle having a flat configuration and comprising two interengaged buckle structures for resisting tension forces applied in opposite directions along a primary direction of the tension forces and along which the buckle can interconnect two members, each structure comprising a first and a second hook.

said first hooks being of like thickness and engaged and hooked together to resist such tension forces and lying in a first stratum corresponding in thickness to the thickness of said first hooks, said second hooks being of like thickness and engaged and hooked together to resist such tension forces and lying in a second stratum corresponding in thickness to the thickness of said second hooks and parallel to said first stratum, said hooks being movable to their engaged position by only relative translational movement of said structures parallel to said strata, and releasable latch means comprising interengageable portions with one such portion on each of said structures, said interengageable portions being engaged when said structures are interconnected to retain said structures against inadvertent unbuckling when said tension forces are relaxed, said first hooks forming a first outer surface on one side of the buckle and said second hooks forming a second outer surface on an opposite side of the buckle.

22. A buckle according to claim 21 wherein said hooks are flat generally parallel structures.

23. A buckle according to claim 21 wherein said latch means comprises a portion defining a recess in a hook of one buckle structure and a protuberant portion on the other buckle structure engaged in the recess.

24. A buckle according to claim 23 wherein said engaged protuberant and recess portions are exposed at an outer face of the buckle.

25. A buckle according to claim 23 wherein each buckle structure includes such a recess and such a protuberant portion thereby forming two sets of engaged protuberant and recess portions exposed at an outer face of the buckle.

26. A buckle according to claim 21 wherein the hooks of one buckle structure ar deflectable and arranged to enable them to slide over the hooks of the other buckle structure during relative end-to-end movement of the buckle structures toward each other along said direction for fastening the buckle structures together.

27. A buckle according to claim 26 wherein said one buckle structure includes belt-attaching means spaced from its hook portions and further includes means, between said hook portions and the belt-attaching means, for resiliently supporting its hook portions to permit their deflection during said end-to-end fastening movement.

28. A buckle according to claim 21 wherein the buckle structures include means whereby fastening of the buckle structures is by movement of one buckle member relative to the other in one direction and whereby unfastening movement is other than merely a reversal of fastening movement and is in a direction distinct from the direction opposite from the fastening direction.

29. A buckle according to claim 28 wherein the fastening movement is end-to-end movement of the buckle structures toward each other.

30. A buckle according to claim 21 wherein the buckle structures include means whereby unfastening of the buckle structures is possible by movement of one buckle member relative to the other by either of two distinct motions along two distinctly different directions.

31. A buckle according to claim 21 wherein each of the hook portions of one buckle structure has a separate hook supporting stem and the tension forces resisted by the buckle are resisted in said one buckle structure essentially entirely by said stems.

* * * * *